US007916093B2

(12) United States Patent
Chiang et al.

(10) Patent No.: US 7,916,093 B2
(45) Date of Patent: Mar. 29, 2011

(54) MULTIBAND ANTENNA

(75) Inventors: Li-Cheng Chiang, Taipei Hsien (TW); Chih-Yuan Yang, Taipei Hsien (TW); Hung-Chang Ko, Taipei Hsien (TW); Po-Wei Kuo, Taipei Hsien (TW); Suo-Bing Su, Taipei Hsien (TW); Wen-Chun Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 379 days.

(21) Appl. No.: 12/241,060

(22) Filed: Sep. 30, 2008

(65) Prior Publication Data

US 2009/0322638 A1 Dec. 31, 2009

(30) Foreign Application Priority Data

Jun. 30, 2008 (CN) ..... 2008 1 0302429

(51) Int. Cl.
*H01Q 13/10* (2006.01)

(52) U.S. Cl. ..... 343/770; 343/700 MS

(58) Field of Classification Search ..... 343/702, 343/700 MS, 767, 769, 770
See application file for complete search history.

(56) References Cited

U.S. PATENT DOCUMENTS

| | | | | |
|---|---|---|---|---|
| 6,573,869 | B2 * | 6/2003 | Moore | 343/702 |
| 6,741,214 | B1 * | 5/2004 | Kadambi et al. | 343/700 MS |
| 7,486,242 | B2 * | 2/2009 | Gala Gala et al. | 343/702 |
| 2001/0048391 | A1 * | 12/2001 | Annamaa et al. | 343/700 MS |
| 2003/0112198 | A1 * | 6/2003 | Wang et al. | 343/770 |
| 2007/0205947 | A1 | 9/2007 | Boyle | |

* cited by examiner

*Primary Examiner* — HoangAnh T Le
(74) *Attorney, Agent, or Firm* — Frank R. Niranjan

(57) ABSTRACT

A multiband antenna includes a conductive sheet, a feeding point, and a grounding point. The conductive sheet defines a first slot, a second slot, a third slot, a fourth slot, a fifth slot, a sixth slot, and a seventh slot thereon. The second slot and the third slot extend from a same short side of the first slot and are parallel to each other. The fourth slot, the fifth slot, the sixth slot, and the seventh slot extend perpendicularly from a short side of the third slot away from the first slot in sequence. The feeding point is formed on the conductive sheet at a long side of the first slot away from the third slot. The grounding point is formed on the conductive sheet at a margin of the slots different from the location of the feeding point.

18 Claims, 2 Drawing Sheets

MULTIBAND ANTENNA

TECHNICAL FIELD

The present invention relates to antennas, and particularly to a multiband antenna.

DESCRIPTION OF THE RELATED ART

Antennas are usually designed to work with a particular wireless access technology in mind. Cellular telephones, for example, contain antennas that are used to handle radio-frequency communications with cellular base stations. Hand-held computers often include short-range antennas for handling wireless connections with wireless access points. Global positioning system (GPS) devices typically contain antennas that are designed to operate at GPS frequencies.

Thus, in order to operate with multiband signals, electronic devices usually must include a number of antennas to accommodate different frequencies. However, as the number of antennas increases this may limit the miniaturization of the electronic device.

What is needed, therefore, is a multiband antenna to overcome the above-described problem.

BRIEF DESCRIPTION OF THE DRAWINGS

Many aspects of the present multiband antenna can be better understood with references to the accompanying drawings. The components in the drawing are not necessarily drawn to scale, the emphasis instead being placed upon clearly illustrating the principles of the present multiband antenna.

DETAILED DESCRIPTION OF THE EMBODIMENTS

Embodiments of the present invention will now be described in detail below, with references to the accompanying drawings.

Figure 1:
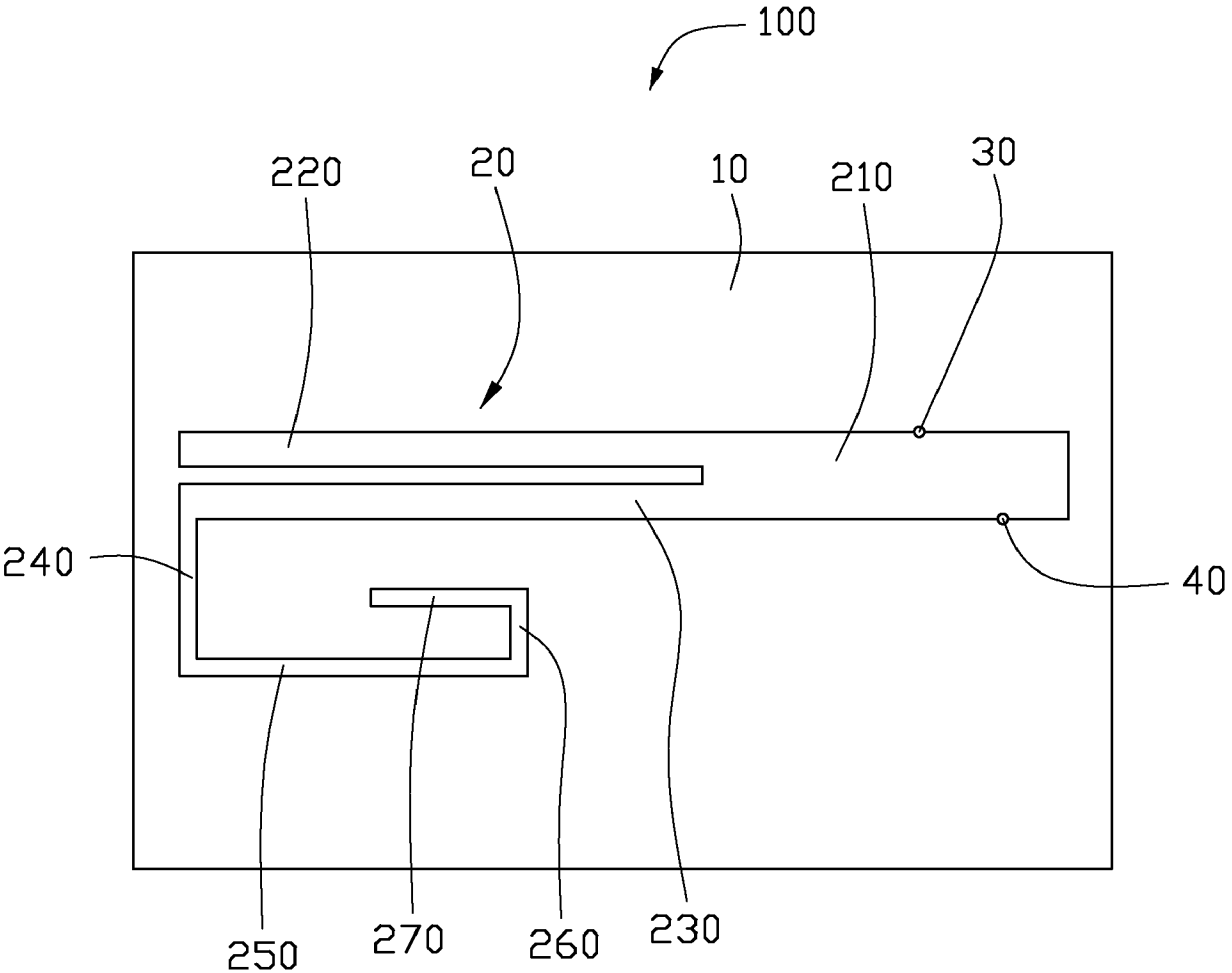
FIG. 1 is a schematic plan view of a multiband antenna according to a first exemplary embodiment.

Referring to FIG. 1, a multiband antenna 100 according to an exemplary embodiment is shown. The multiband antenna 100 includes a conductive sheet 10 defining a slot structure 20, a feeding point 30, and a grounding point 40.

The conductive sheet 10 can be a metal sheet or a circuit board. In the present embodiment, the conductive sheet 10 is a metal sheet. The slot structure 20 can be formed on the conductive sheet 10 by punching. If the conductive sheet 10 is a circuit board the slot structure 20 can be formed on the conductive sheet 10 by etching.

The slot structure 20 includes a first slot 210, a second slot 220, a third slot 230, a fourth slot 240, a fifth slot 250, a sixth slot 260, and a seventh slot 270. In the present embodiment, all of the above slots are rectangular. Each of the slots has two opposite short sides and two opposite long sides longer than the short sides.

The second slot 220 and the third slot 230 extend from a same short side of the first slot 210 and are parallel to each other. The short sides of the second slot 220 and the third slot 230 are parallel to the short sides of the first slot 210. The fourth slot 240, the fifth slot 250, the sixth slot 260, and the seventh slot 270 extend from a short side of the third slot 230 and away from the first slot 210 in sequence. The fourth slot 240, the fifth slot 250, the sixth slot 260, and the seventh slot 270 are curved inwards and extend perpendicular to the third slot 230, the fourth slot 240, the fifth slot 250, and the sixth slot 260, respectively. The third slot 230 and the fifth slot 250 are at the same side as the fourth slot 240, the fourth slot 240 and the sixth slot 260 are at the same side as the fifth slot 250, and the fifth slot 250 and the seventh slot 270 are at the same side as the sixth slot 260.

In the present embodiment, the length of the first slot 210 is approximately 20 mm and the width is approximately 5 mm. The length of the second slot 220 is approximately 30 mm and the width is approximately 2 mm. The size of the third slot 230 is the same as that of the second slot 220. The widths of the fourth slot 240, the fifth slot 250, the sixth slot 260, and the seventh slot 270 are 1 mm. The lengths of the fourth slot 240, the fifth slot 250, the sixth slot 260, and the seventh slot 270 are 8 mm, 20 mm, 3 mm, and 8 mm, respectively. The distance between the second slot 220 and the third slot 230 is approximately 1 mm.

The feeding point 30 is formed on the conductive sheet 10 at a long side of the first slot 210 away from the third slot 230. In the present embodiment, the distance from the feeding point 30 to the short side of the first slot 210 away from the third slot 230 is approximately 8.5 mm.

The grounding point 40 is formed on the conductive sheet 10 at a margin of the slot structure 20 different from the location of the feeding point 30.

Figure 2:
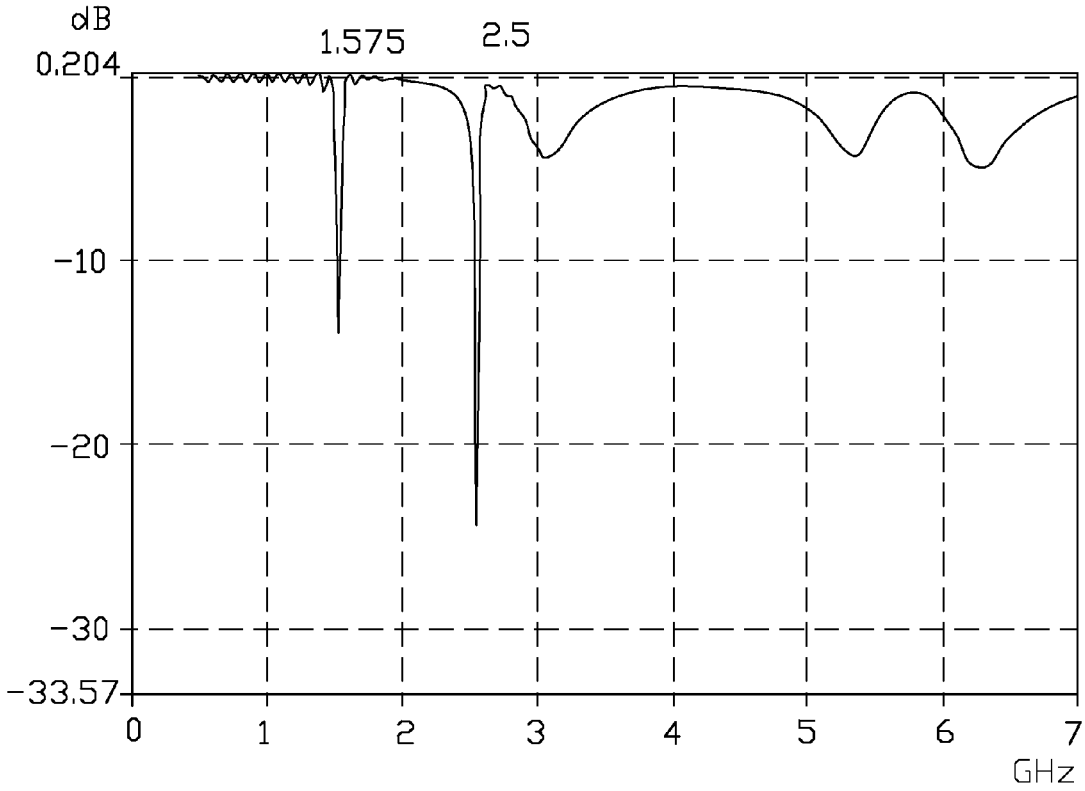
FIG. 2 is a schematic diagram showing the return loss versus frequency characteristic of the multiband antenna of FIG. 1.

In the present embodiment, the first slot 210 and the second slot 220 as a whole is capable of operating under a first frequency band for receiving or radiating Institute of Electrical and Electronics Engineers, Inc. (IEEE) 802.11 wireless standard (802.11) signals. The first slot 210, the third slot 230, the fourth slot 240, the fifth slot 250, the sixth slot 260, and the seventh slot 270 as a whole is capable of operating under a second frequency band for receiving or radiating GPS signals. Referring to FIG. 2, the antenna 100 achieves a return loss smaller than −10 dB at approximately 1.575 GHz, which is the second frequency band for receiving or radiating GPS signals. The antenna 100 achieves a return loss smaller than −20 dB at approximately 2.5 GHz, which is the first frequency band for receiving or radiating IEEE 802.11 signals. Moreover, the antenna 100 can operate under two frequency bands for receiving or radiating IEEE 802.11 and GPS signals.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. A multiband antenna comprising:

a conductive sheet defining a first slot, a second slot, a third slot, a fourth slot, a fifth slot, a sixth slot, and a seventh slot thereon, the second slot and the third slot extending from a same short side of the first slot and are parallel to each other, the fourth slot, the fifth slot, the sixth slot, and the seventh slot extending perpendicularly from a short side of the third slot and away from the first slot in sequence;

a feeding point formed on the conductive sheet at a long side of the first slot away from the third slot; and a grounding point formed on the conductive sheet at a margin of the slots different from the location of the feeding point.

2. The multiband antenna as claimed in claim 1, wherein the conductive sheet is a metal sheet.

3. The multiband antenna as claimed in claim 1, wherein the conductive sheet is a circuit board.

4. The multiband antenna as claimed in claim 2, wherein the slots are formed on the conductive sheet by punching.

5. The multiband antenna as claimed in claim 3, wherein the slots are formed on the conductive sheet by etching.

6. The multiband antenna as claimed in claim 1, wherein the first slot and the second slot as a whole operate under a first frequency band for receiving or radiating IEEE 802.11 Wireless Standard signals, and the first slot, the third slot, the fourth slot, the fifth slot, the sixth slot, and the seventh slot as a whole operate under a second frequency band for receiving or radiating GPS signals.

7. The multiband antenna as claimed in claim 1, wherein the length of the first slot is approximately 20 mm and the width is approximately 5 mm, the lengths of the second slot and the third slot are approximately 30 mm and the widths are approximately 2 mm, the widths of the fourth slot, the fifth slot, the sixth slot, and the seventh slot are 1 mm, the lengths of the fourth slot, the fifth slot, the sixth slot, and the seventh slot are 8 mm, 20 mm, 3 mm, and 8 mm, respectively.

8. The multiband antenna as claimed in claim 7, wherein the distance between the second slot and the third slot is approximately 1 mm.

9. The multiband antenna as claimed in claim 1, wherein the distance from the feeding point to the short side of the first slot away from the third slot is approximately 8.5 mm.

10. A multiband antenna comprising:

a conductive sheet defining a slot structure thereon, the slot structure comprising a first slot, a second slot, a third slot, a fourth slot, a fifth slot, a sixth slot, and a seventh slot, the second slot and the third slot extending from a same side of the first slot and are parallel to each other, the fourth slot, the fifth slot, the sixth slot, and the seventh slot curved inwards and extending perpendicularly from a side of the third slot and away from the first slot in sequence;

a feeding point formed at a long side of the first slot; and a grounding point formed at a side of the slot structure different from the location of the feeding point.

11. The multiband antenna as claimed in claim 10, wherein the conductive sheet is a metal sheet.

12. The multiband antenna as claimed in claim 10, wherein the conductive sheet is a circuit board.

13. The multiband antenna as claimed in claim 11, wherein the slots are formed on the conductive sheet by punching.

14. The multiband antenna as claimed in claim 12, wherein the slots are formed on the conductive sheet by etching.

15. The multiband antenna as claimed in claim 10, wherein the first slot and the second slot as a whole operate under a first frequency band for receiving or radiating IEEE 802.11 Wireless Standard signals, and the first slot, the third slot, the fourth slot, the fifth slot, the sixth slot, and the seventh slot as a whole operate under a second frequency band for receiving or radiating GPS signals.

16. The multiband antenna as claimed in claim 10, wherein the length of the first slot is approximately 20 mm and the width is approximately 5 mm, the lengths of the second slot and the third slot are approximately 30 mm and the widths are approximately 2 mm, the widths of the fourth slot, the fifth slot, the sixth slot, and the seventh slot are 1 mm, the lengths of the fourth slot, the fifth slot, the sixth slot, and the seventh slot are 8 mm, 20 mm, 3 mm, and 8 mm, respectively.

17. The multiband antenna as claimed in claim 16, wherein the distance between the second slot and the third slot is approximately 1 mm.

18. The multiband antenna as claimed in claim 10, wherein the distance from the feeding point to the side of the first slot away from the third slot is approximately 8.5 mm.

* * * * *